US008487924B2

(12) United States Patent
Jin et al.

(10) Patent No.: US 8,487,924 B2
(45) Date of Patent: Jul. 16, 2013

(54) APPARATUS FOR DRIVING OF DISPLAY PANEL

(75) Inventors: Tae Jin, Seoul (KR); Suyeol Lee, Seoul (KR); Young Suk Shin, Seoul (KR); Sung Cheon Park, Suwon-si (KR)

(73) Assignee: Dongwoon Anatech Co., Ltd. (KR)

( * ) Notice: Subject to any disclaimer, the term of this patent is extended or adjusted under 35 U.S.C. 154(b) by 322 days.

(21) Appl. No.: 12/987,038

(22) Filed: Jan. 7, 2011

(65) Prior Publication Data

US 2012/0050249 A1 Mar. 1, 2012

(30) Foreign Application Priority Data

Aug. 25, 2010 (KR) ..... 10-2010-0082544
Oct. 4, 2010 (KR) ..... 10-2010-0096325

(51) Int. Cl.
*G09G 5/00* (2006.01)

(52) U.S. Cl.
USPC ..... 345/212; 345/204; 345/211; 323/282

(58) Field of Classification Search
USPC ..... 323/282; 345/204, 211–213
See application file for complete search history.

(56) References Cited

U.S. PATENT DOCUMENTS

2003/0227452 A1* 12/2003 Hartular ..... 345/211
2007/0285071 A1* 12/2007 Su et al. ..... 323/282

FOREIGN PATENT DOCUMENTS

JP 2007-033979 A 2/2007
KR 20-0119365 Y1 8/1998
KR 10-2005-0050154 A 5/2005
KR 10-2006-0016275 A 2/2006

* cited by examiner

*Primary Examiner* — Koosha Sharifi-Tafreshi
(74) *Attorney, Agent, or Firm* — Knobbe Martens Olson & Bear, LLP

(57) ABSTRACT

Provided is an apparatus for driving a display panel. A short circuit can be detected by detecting a current (due to the short circuit) applied to a display panel through a low-dropout (LDO) regulator during a black data period. In addition, power applied to the display panel from a DC-DC converter can be turned off according to the short-circuit detection result.

3 Claims, 7 Drawing Sheets

APPARATUS FOR DRIVING OF DISPLAY PANEL

CROSS-REFERENCE TO RELATED APPLICATION

This application claims priority to Korean Patent Application No. 2010-82544, filed on 25 Aug. 2010 and Korean Patent Application No. 2010-96325, filed on 4 Oct. 2010, and all the benefits accruing therefrom under 35 U.S.C. §119, the contents of which in its entirety are herein incorporated by reference.

BACKGROUND

1. Field

This disclosure relates to an apparatus for driving a display panel, and more particularly, to an apparatus for driving a display panel capable of, in a case where a power source to be applied to a display panel is short-circuited due to a crack in the display panel, sensing the short circuit and turning off the power applied to the display panel from a DC-DC converter.

2. Description of the Related Art

With the development of semiconductor fabrication techniques and image processing techniques, commercialization and supply of flat panel displays which easily achieve reductions in weight and thickness and implement high image quality have rapidly advanced. As such flat panel display devices, there are liquid crystal displays (LCDs), plasma display panels (PDPs), vacuum fluorescent displays (VFDs), organic light-emitting diodes (OLEDs), and the like.

From among the flat panel display devices, LCDs and OLEDs have been widely employed in personal portable devices such as portable phones, PDAs, and portable computers due to their light weights, small thicknesses, and easy implementation of high image quality, and have been widely used particularly for external and internal windows of portable phones having dual windows.

Particularly, OLEDs are self-light-emitting and do not include backlights unlike LCDs, so that they are thinner, have faster response times of the order of tens of nanoseconds, have wide viewing angles and good contrast ratio, and thus are gaining attentions as the next-generation display.

As the display panels become thinner, there may be a case where cracks occur in the display panels due to external impacts. In this case, a short circuit occurs, and thus overcurrent flows through the display panel, resulting in increase in temperature and burn-out of the display panel. In addition, due to the short circuit, the DC-DC converter becomes overloaded, and thus the DC-DC converter itself or an inductor which is a peripheral component of the DC-DC converter may be damaged, affecting other nearby circuits.

As methods for solving the above-described problems, in the related art, only the mechanisms for protecting the DC-DC converter or the inductor exist, not the mechanism for protecting the panel itself.

Soft-start and thermal shutdown (TSD) functions are examples of the protective mechanisms of the DC-DC converters.

However, the TSD function is restored if the display panel temperature decreases due to hysteresis characteristics, and power is applied from the DC-DC converter to the display panel again. As a result, overcurrent flows through the display panel again and the temperature increases. Then, the power applied to the display panel from the DC-DC converter is turned off by the TSD function. Such operations are performed repeatedly. Moreover, in a case where a micro-short circuit (of about several milliamperes), not the complete short circuit, occurs in a drive region of the DC-DC converter, such functions cannot be operated.

SUMMARY

This disclosure provides an apparatus for driving a display panel which has a short-circuit detecting unit that detects a current that occurs due to a short circuit during a black data period in which current should not flow through a display panel, thereby turning off power applied to the display panel from a DC-DC converter.

This disclosure also provides an apparatus for driving a display panel which adjusts a level of a short-circuit current that can be detected by a short-circuit detecting unit by changing a ratio of a pass transistor of a low-dropout (LDO) regulator and a sensing transistor of a short-circuit detecting unit, thereby detecting a micro-short-circuit current that occurs due to a micro-short circuit.

This disclosure also provides an apparatus for driving a display panel which detects whether or not a drive current applied to a display panel exceeds a preset maximum drive current due to a current that occurs due to a micro-short circuit while the display panel is driven, thereby turning off power applied to the display panel from a DC-DC converter.

This disclosure also provides an apparatus for driving a display panel which detects whether or not a drive current applied to a display panel exceeds a maximum drive current of the display panel that is set according to a size value of an inductor or characteristics of external components due to surrounding environments to turn off power applied to the display panel from a DC-DC converter, thereby protecting the inductor or the external components.

In one aspect, there is provided an apparatus for driving a display panel including: a display panel; a DC-DC converter for raising a constant voltage supplied from a power source unit to a drive voltage of the display panel and outputting the raised voltage; an LDO regulator for dropping an output voltage of the DC-DC converter and supplying the dropped output voltage to the display panel; and a black data period short-circuit detecting unit which is enabled during a black data period in which a current should not flow through the display panel, detects a short circuit by detecting a short-circuit current applied to the display panel through the LDO regulator, and outputs a short-circuit detection signal to the DC-DC converter according to the short-circuit detection result, thereby controlling the output voltage of the DC-DC converter.

The black data period short-circuit detecting unit may include: a sensing transistor which is configured so that a pass transistor of the LDO regulator and the sensing transistor are implemented at a ratio of N:1, and detects a short-circuit current flowing through the pass transistor; a resistor which is connected to an output terminal of the sensing transistor and converts the short-circuit current detected by the sensing transistor into a voltage; and a comparator which compares the voltage converted by the resistor with a reference voltage and outputs a short-circuit detection signal.

The sensing transistor may be implemented as a PMOS transistor having a gate terminal to which a signal output from an error amplifier of the LDO regulator is applied and a source terminal to which the output voltage of the DC-DC converter is applied.

The comparator may output a short-circuit detection signal at a low level to a PWM controller of the DC-DC converter until the voltage converted by the resistor becomes greater than the reference voltage.

A level of the short-circuit current that can be detected by the black data period short-circuit detecting unit may be adjusted by changing at least one of the ratio of the pass transistor and the sensing transistor and a resistance of the resistor.

An operational amplifier and a transistor which cause voltages output from an output end of the pass transistor and an output end of the sensing transistor to be equal to each other may further included, wherein the voltage output from the output end of the pass transistor is input to a non-inverting input terminal of the operational amplifier, and the voltage output from the output end of the sensing transistor is input to an inverting input terminal of the operational amplifier, and the transistor is implemented between the sensing transistor and the resistor, and receives the short-circuit current output from the sensing transistor through a source terminal of the transistor depending on the output voltage of the operational amplifier which is input through a gate terminal of the transistor, and outputs the short-circuit current to the resistor.

In another aspect, there is provided an apparatus for driving a display panel including: a display panel; a DC-DC converter for raising a constant voltage supplied from a power source unit to a drive voltage of the display panel and outputting the raised voltage; an LDO regulator for dropping an output voltage of the DC-DC converter and supplying the dropped output voltage to the display panel; and a image data period short-circuit detecting unit which is enabled during an image data period in which image data is applied to the display panel, detects a short circuit by detecting whether or not a drive current applied to the display panel through the LDO regulator exceeds a maximum drive current, and outputs a short-circuit detection signal to the DC-DC converter according to the short-circuit detection result, thereby controlling the output voltage of the DC-DC converter.

The image data period short-circuit detecting unit may include: a sensing transistor which is configured so that a pass transistor of the LDO regulator and the sensing transistor are implemented at a ratio of N:1, and detects a drive current flowing through the pass transistor; a resistor which is connected to a drain terminal of the sensing transistor and converts the drive current detected by the sensing transistor into a voltage; and a comparator which compares the voltage converted by the resistor with a reference voltage and outputs a short-circuit detection signal.

In another aspect, there is provided an apparatus for driving a display panel including: a display panel; a DC-DC converter for raising a constant voltage supplied from a power source unit to a drive voltage of the display panel and outputting the raised voltage; an LDO regulator for dropping an output voltage of the DC-DC converter and supplying the dropped output voltage to the display panel; a black data period short-circuit detecting unit which is enabled during a black data period in which current should not flow through the display panel, detects a short circuit by detecting a short-circuit current applied to the display panel through the LDO regulator, and outputs a short-circuit detection signal to the DC-DC converter according to the short-circuit detection result, thereby controlling the output voltage of the DC-DC converter; and a image data period short-circuit detecting unit which is enabled during an image data period in which image data is applied to the display panel, detects a short circuit by detecting whether or not a drive current applied to the display panel through the LDO regulator exceeds a maximum drive current, and outputs a short-circuit detection signal to the DC-DC converter according to the short-circuit detection result, thereby controlling the output voltage of the DC-DC converter.

The black data period short-circuit detecting unit may include: a first sensing transistor which is configured so that a pass transistor of the LDO regulator and the sensing transistor are implemented at a ratio of N:1, and detects a drive current flowing through the pass transistor; a first resistor which is connected to a drain terminal of the first sensing transistor and converts the short-circuit current detected by the first sensing transistor into a voltage; and a first comparator which compares the voltage converted by the first resistor to a first reference voltage and outputs a short-circuit detection signal.

The image data period short-circuit detecting unit may include: a second sensing transistor which is configured so that a pass transistor of the LDO regulator and the sensing transistor are implemented at a ratio of N:1, and detects a drive current flowing through the pass transistor; a second resistor which is connected to a drain terminal of the second sensing transistor and converts the drive current detected by the second sensing transistor into a voltage; and a second comparator which compares the voltage converted by the second resistor to a second reference voltage and outputs a short-circuit detection signal.

With the disclosed apparatus for driving a display panel, a short circuit can be detected by detecting a current applied to the display panel (due to the short circuit) through the LDO regulator during the black data period. In addition, power applied to the display panel from the DC-DC converter can be turned off according to the short-circuit detection result.

In addition, the level of the short-circuit current that can be detected by the short-circuit detecting unit may be adjusted by changing the ratio of the pass transistor of the LDO regulator and the sensing transistor of the short-circuit detecting unit, thereby detecting a micro-short-circuit current that occurs due to a micro-short circuit.

In addition, a micro-short circuit in a drive region of the DC-DC converter can be detected while the display panel is driven, by detecting whether or not the drive current applied to the display panel exceeds the preset maximum drive current due to the current caused by the micro-short circuit while the display panel is driven. In addition, the power applied to the display panel from the DC-DC converter is turned off according to the short-circuit detection result, thereby preventing the display panel from being damaged more significantly and protecting the DC-DC converter, the inductor, and the like.

Whether or not the drive current applied to the display panel exceeds the maximum drive current of the display panel which is set according to the size value of the inductor and the characteristics of external components due to surrounding environments is detected to turn off the power applied to the display panel from the DC-DC converter. Accordingly, a current that exceeds the current that can be accommodated by the inductor or the external components is blocked, thereby preventing the inductor or the external components from being heated.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Figure 1:
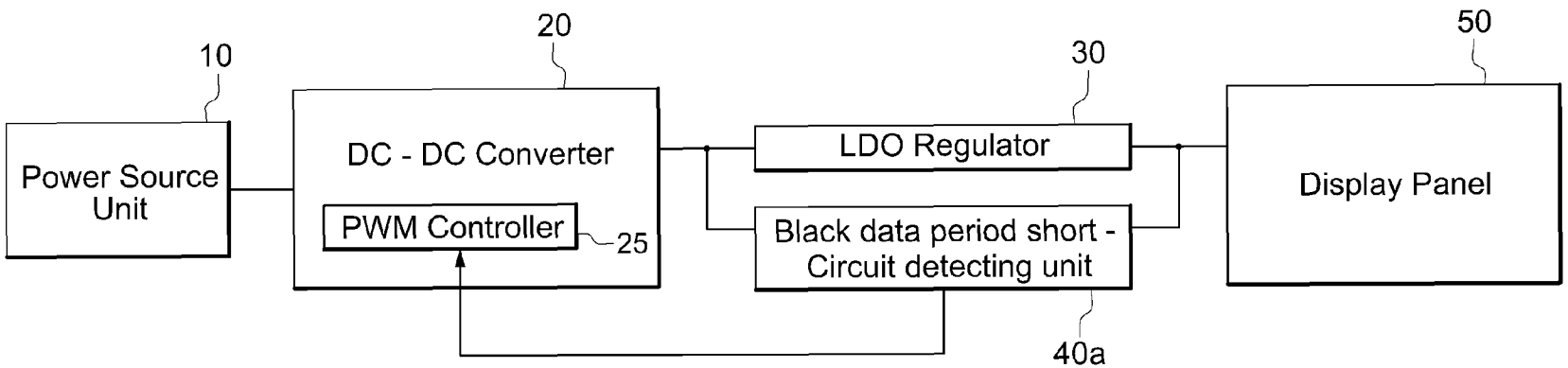
FIG. 1 is a diagram schematically illustrating an apparatus for driving a display panel according to a first embodiment.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements. The shape, size and regions, and the like, of the drawing may be exaggerated for clarity.

Hereinafter, an apparatus for driving a display panel according to exemplary embodiments will be described in detail with reference to the accompanying drawings.

FIG. 1 is a diagram schematically illustrating an apparatus for driving a display panel according to a first embodiment.

In FIG. 1, a power source unit 10 supplies a constant voltage to a DC-DC converter 20.

The DC-DC converter 20 raises the constant voltage supplied to the power source unit 10 to a drive voltage of a display panel 50 so as to be output.

The DC-DC converter 20 includes a PWM controller 25 for controlling driving of the DC-DC converter 20.

The PWM controller 25 controls an output voltage of the DC-DC converter 20 on the basis of a signal applied from a black date period short-circuit detecting unit 40*a*.

That is, the PWM controller 25 applies a voltage from the DC-DC converter 20 to the display panel 50 in a case where a low-level signal is applied from the black date period short-circuit detecting unit 40*a*, and turns off the voltage applied from the DC-DC converter 20 to the display panel 50 in a case where a high-level signal is applied from the black date period short-circuit detecting unit 40*a*.

A low-dropout (LDO) regulator 30 drops the output voltage of the DC-DC converter 20 and supplies the dropped voltage to the display panel 50.

The black date period short-circuit detecting unit 40*a* is implemented between the display panel 50 and the DC-DC converter 20, is enabled during a black data period in which current should not flow through the display panel 50, detects a short circuit by detecting a current applied to the display panel 50 from the DC-DC converter 20 through the LDO regulator 30, and outputs a short-circuit detection signal to the DC-DC converter 20 according to the short-circuit detection result.

That is, in a case where drive power sources ELVDD and ELVSS applied to the display panel 50 are short-circuited due to a crack in the display panel 50, a short-circuit current flows from the DC-DC converter 20 to the display panel 50.

However, in a case where the crack in the display panel 50 is very small, the short-circuit current flowing from the DC-DC converter 20 to the display panel 50 is low, so that the low short-circuit current cannot be detected during the driving of the display panel 50.

Thus, the black date period short-circuit detecting unit 40*a* is enabled during the black data period in which current does not flow through the display panel 50 in a state where there is no crack in the display panel 50, and detects whether or not a short-circuit current flows from the DC-DC converter 20 to the display panel 50 during the black data period. Here, in a case where there is no crack in the display panel 50, short-circuit current does not flow from the DC-DC converter 20 to the display panel 50, and in a case where a crack occur in the display panel 50, a short-circuit current flows from the DC-DC converter 20 to the display panel 50.

As such, the black date period short-circuit detecting unit 40*a* for detecting a short-circuit current during the black data period detects the short-circuit current and applies a short-circuit detection signal to the PWM controller 25 of the DC-DC converter 20 according to the detection result.

Here, the black data period is a period in which black data is applied before image data is applied to the display panel 50 in response to a display panel drive signal. Normally, current does not flow through the display panel 50 while the black data is applied.

Figure 2:
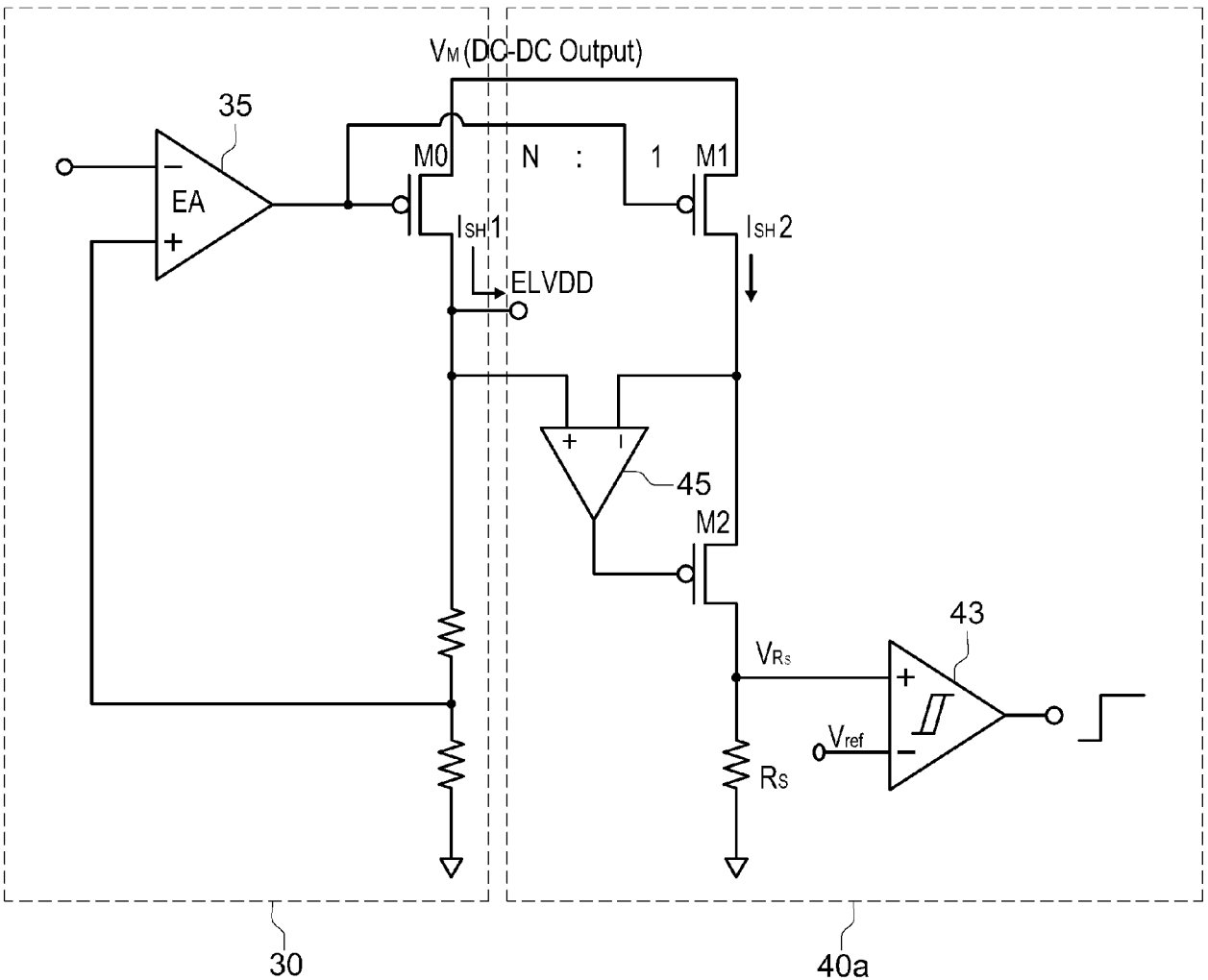
FIG. 2 is a circuit diagram illustrating a black data period short-circuit detecting unit according to the first embodiment.

FIG. 2 is a circuit diagram illustrating the black date period short-circuit detecting unit 40*a* according to the first embodiment.

The black date period short-circuit detecting unit 40*a* includes, as illustrated in FIG. 2, a sensing transistor M1, a resistor $R_S$, a comparator 43, an operational amplifier 45, and a transistor M2.

In this configuration, a pass transistor M0 of the LDO regulator 30 and the sensing transistor M1 are implemented at a ratio of N:1 (for example, 100:1) to detect a short-circuit current flowing through the pass transistor M0. The magnitude of the current that can be detected by the sensing transistor M1 varies depending on the ratio of the pass transistor M0 and the sensing transistor M1. Thus, a level of the short-circuit current that can be detected by the short-circuit detecting unit 40 may be adjusted by changing the ratio of the pass transistor M0 and the sensing transistor M1.

The sensing transistor M1 may be implemented as a PMOS transistor. In this case, a signal output from an error amplifier 35 of the LDO regulator 30 is applied to a gate terminal of the PMOS transistor M1, and an output voltage $V_M$ of the DC-DC converter 20 is applied to a source terminal thereof.

The resistor $R_S$ is connected to an output terminal of the sensing transistor M1 to convert a short-circuit current $I_{SH}$2 detected by the sensing transistor M1 into a voltage $V_{Rs}$. Here, the value of the voltage $V_{Rs}$ varies depending on the resistance of the resistor $R_S$. Thus, the level of the short-circuit current that can be detected by the short-circuit detecting unit 40 may be adjusted by changing the resistance of the resistor $R_S$.

As described above, the level of the short-circuit current that can be detected by the black date period short-circuit detection unit 40*a* may be adjusted by changing the ratio of the pass transistor M0 and the sensing transistor M1, and the resistance of the resistor $R_S$. Accordingly, a short-circuit current of a micro-short circuit that occurs due to micro-cracks can be detected.

The comparator 43 compares the voltage $V_{Rs}$ converted by the resistor $R_S$ with a reference voltage $V_{ref}$ and outputs a short-circuit detection signal.

The comparator 43 outputs a short-circuit detection signal of a low level to the PWM controller 25 of the DC-DC converter 20 until the voltage $V_{Rs}$ converted by the resistor $R_S$ becomes greater than the reference voltage $V_{ref}$, and outputs a short-circuit detection signal of a high level to the PWM controller 25 of the DC-DC converter 20 when the voltage $V_{Rs}$ converted by the resistor $R_S$ becomes equal to or greater than the reference voltage $V_{ref}$.

Accordingly, in a case where the PWM controller 25 receives the short-circuit detection signal of the low level from the comparator 43, the PWM controller 25 generates a PWM control signal and applies it to a switch transistor (not shown) so as to apply power from the DC-DC converter 20 to the display panel 50. In addition, in a case where the PWM controller 25 receives the short-circuit detection signal of the high level from the comparator 43, the PWM controller 25 does not generate the PWM control signal to be output to the switch transistor (not shown) so as not to apply power from the DC-DC converter 20 to the display panel 50.

The black date period short-circuit detecting unit 40*a* may further include the operational amplifier 45 and the transistor M2 so as to cause voltages output from output ends of the pass transistor M0 and the sensing transistor M1 to be equal to each other.

The voltage output from the output end of the pass transistor M0 is input to a non-inverting input terminal (+) of the operational amplifier 45, and the voltage output from the output end of the sensing transistor M1 is input to an inverting input terminal (−) thereof.

The transistor M2 is implemented between the sensing transistor M1 and the resistor $R_S$, and depending on an output voltage of the operational amplifier 45 input through a gate terminal thereof, receives the short-circuit current $I_{SH}$2 output from the sensing transistor M1 through a source terminal thereof to output it to the resistor $R_S$.

Figure 3:
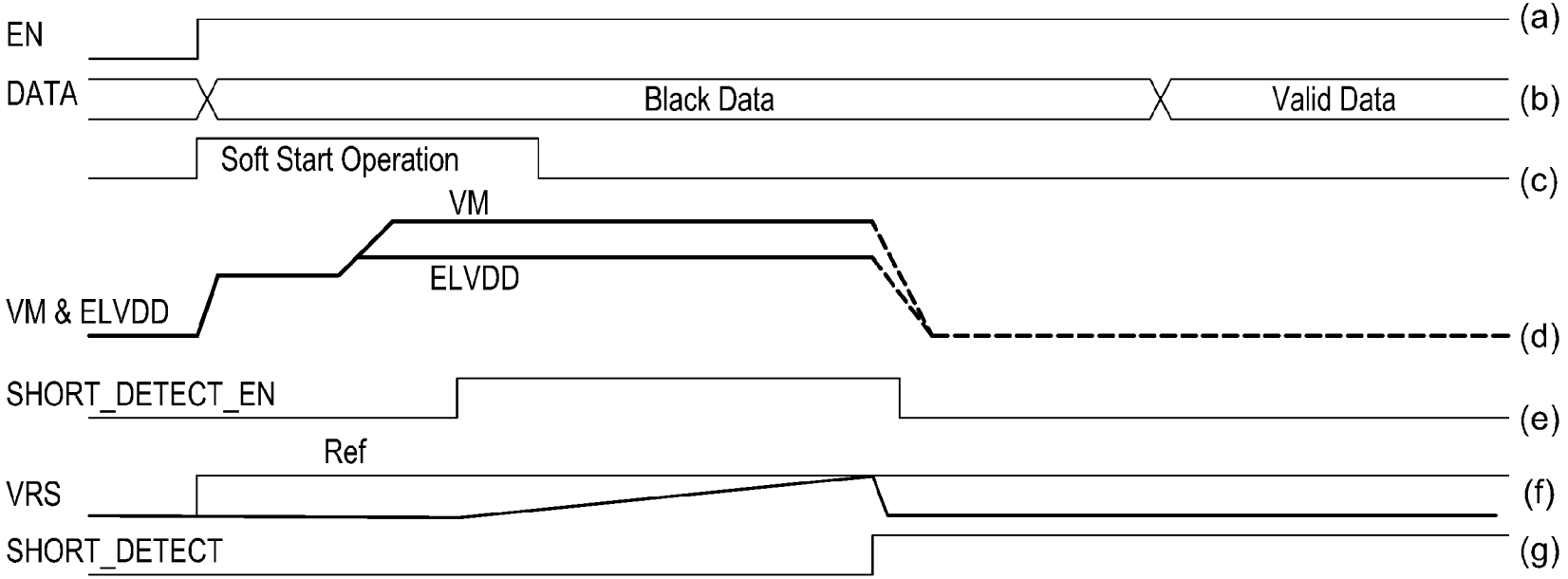
FIG. 3 is a timing diagram of operations of the apparatus for driving a display panel according to the first embodiment.

FIG. 3 is a timing diagram of operations of the apparatus for driving a display panel according to the first embodiment.

First, when the display panel 50 is enabled in response to the display panel drive signal (a), image data is applied to the display panel 50, and black data is applied for a preset time (for example, 16 ms) before the image data is applied (b). Here, when the display panel 50 is in a normal state during the black data period in which the black data is applied, current does not flow through the display panel 50. However, in a case where a crack occur in the display panel 50 and the power sources ELVDD and ELVSS are short-circuited, a short-circuit current flows through the display panel 50 during the black data period.

Accordingly, in order to detect the short-circuit current, after a soft-start operation (c), the short-circuit detecting unit 40 is enabled from a time point at which the power source ELVDD is stabilized (d, e).

As described above, when the black date period short-circuit detecting unit 40*a* is enabled during the black data period, the black date period short-circuit detecting unit 40*a* detects a current flowing from the DC-DC converter 20 to the display panel 50 in the case where the power sources ELVDD and ELVSS are short-circuited due to the crack in the display panel 50.

That is, when the black date period short-circuit detecting unit 40*a* is enabled, the sensing transistor M1 of the black date period short-circuit detecting unit 40*a* detects the short-circuit current flowing through the pass transistor M0 of the LDO regulator 30.

In the case where there is no crack in the display panel 50, a short-circuit current does not flow to the display panel 50 from the DC-DC converter 20.

As such, when current does not flow to the display panel 50 from the DC-DC converter 20, the voltage $V_{Rs}$ applied to the non-inverting input terminal (+) of the comparator 43 is smaller than the reference voltage $V_{ref}$ (for example, 0.6 V) applied to the inverting input terminal (−) of the comparator 43, and the short-circuit detection signal of the low level is output to the PWM controller 25 of the DC-DC converter 20.

The PWM controller 25 that receives the short-circuit detection signal of the low level from the black date period short-circuit detecting unit 40*a* generates the PWM control signal and applies it to the switch transistor (not shown) so as to apply power from the DC-DC converter 20 to the display panel 50.

On the other hand, in the case where a crack occurs in the display panel 50, a short-circuit current flows from the DC-DC converter 20 to the display panel 50.

As such, when the short-circuit current flows from the DC-DC converter 20 to the display panel 50, a short-circuit current $I_{SH}$1 flows through the pass transistor M0 of the LDO regulator 30. In this case, the short-circuit current $I_{SH}$2 also flows through the sensing transistor M1 of which the gate terminal is connected to the output signal of the error amplifier 35 like the pass transistor M0 and of which the source terminal is connected to the output voltage $V_M$ of the DC-DC converter 20.

Here, magnitudes of the short-circuit current $I_{SH}$1 flowing through the pass transistor M0 and the short-circuit current $I_{SH}$2 flowing through the sensing transistor M1 vary depending on the ratio of the pass transistor M0 and the sensing transistor M1. For example, in a case where the ratio of the pass transistor M0 and the sensing transistor M1 is 100:1, if a short-circuit current $I_{SH}$1 of 100 mA flows through the pass transistor M0, a short-circuit current $I_{SH}$2 of 1 mA flows through the sensing transistor M1.

As described above, the short-circuit current $I_{SH}$2 flowing through the sensing transistor M1 is converted into the voltage $V_{Rs}$ by the resistor $R_S$ and applied to the non-inverting input terminal (+) of the comparator 43. In this case, when the voltage $V_{Rs}$ converted by the resistor $R_S$ becomes equal to or greater than the reference voltage $V_{ref}$ connected to the inverting input terminal (−) of the comparator 43, as illustrated by (f) of FIG. 3, the short-circuit detection signal of the high level is output to the PWM controller 25 of the DC-DC converter 20, as illustrated by (g) of FIG. 3.

The PWM controller 25 which receives the short-circuit detection signal of the high level from the black date period short-circuit detecting unit 40*a* does not generate the PWM control signal to be applied to the switch transistor (not shown) so as not to apply power from the DC-DC converter 20 to the display panel 50.

Figure 4:
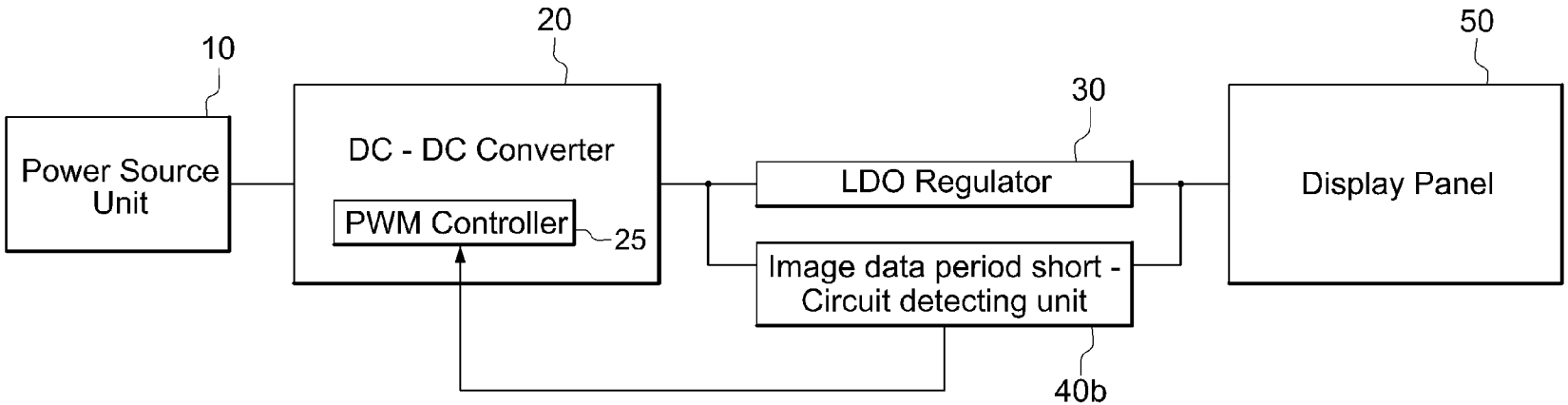
FIG. 4 is a diagram schematically illustrating an apparatus for driving a display panel according to a second embodiment.

FIG. 4 is a diagram schematically illustrating an apparatus for driving a display panel according to a second embodiment;

In FIG. 4, a power source unit 10 supplies a constant voltage to a DC-DC converter 20.

The DC-DC converter 20 raises the constant voltage supplied to the power source unit 10 to a drive voltage of a display panel 50 so as to be output.

The DC-DC converter 20 includes a PWM controller 25 for controlling driving of the DC-DC converter 20.

That is, the PWM controller 25 applies a voltage from the DC-DC converter 20 to the display panel 50 in a case where a low-level signal is applied from the image date period short-circuit detecting unit 40*b*, and turns off the voltage applied from the DC-DC converter 20 to the display panel 50 in a case where a high-level signal is applied from the image date period short-circuit detecting unit 40*b*.

The image date period short-circuit detecting unit 40*b* is implemented between the display panel 50 and the DC-DC converter 20 and is enabled during an image data period in which image data is applied, that is, while the display panel 50 is driven and a drive current is applied to the display panel 50. In addition, the image data period short-circuit detecting unit 40*b* detects a short circuit by detecting whether or nor the drive current applied from the DC-DC converter 20 to the display panel 50 through the LDO regulator 30 during the image data period exceeds a maximum drive current, and outputs a short-circuit detection signal to the DC-DC converter 20 according to the short-circuit detection result.

In the case where drive power sources ELVDD and ELVSS applied to the display panel 50 are short-circuited due to a micro-crack that occurs during the driving of the display panel 50, this cannot be detected by the black data period short-circuit detecting unit 40*a*. In addition, in the case where the crack that occurs during the driving is very small, the short-circuit current flowing from the DC-DC converter 20 to the display panel 50 is small, so that this cannot be detected during the driving of the display panel 50 using the TSD and current limit functions according to the related art.

Accordingly, the image date period short-circuit detecting unit 40*b* is enabled during the image data period, and detects whether or not the drive current applied to the display panel 50 from the DC-DC converter 20 exceeds the maximum drive current while the drive current is applied to the display panel 50. In the case where there is no crack in the display panel 50, the drive current applied to the display panel 50 from the DC-DC converter 20 does not exceed the maximum drive current, and in the case where a crack occurs in the display panel 50, the drive current applied to the display panel 50 from the DC-DC converter 20 exceeds the maximum drive current.

As such, while the display panel 50 is driven, whether or not the drive current applied from the DC-DC converter 20 to the display panel 50 exceeds the preset maximum drive current is detected, and according to the detection result, the short-circuit detection signal is applied to the PWM controller 25 of the DC-DC converter 20.

Figure 5:
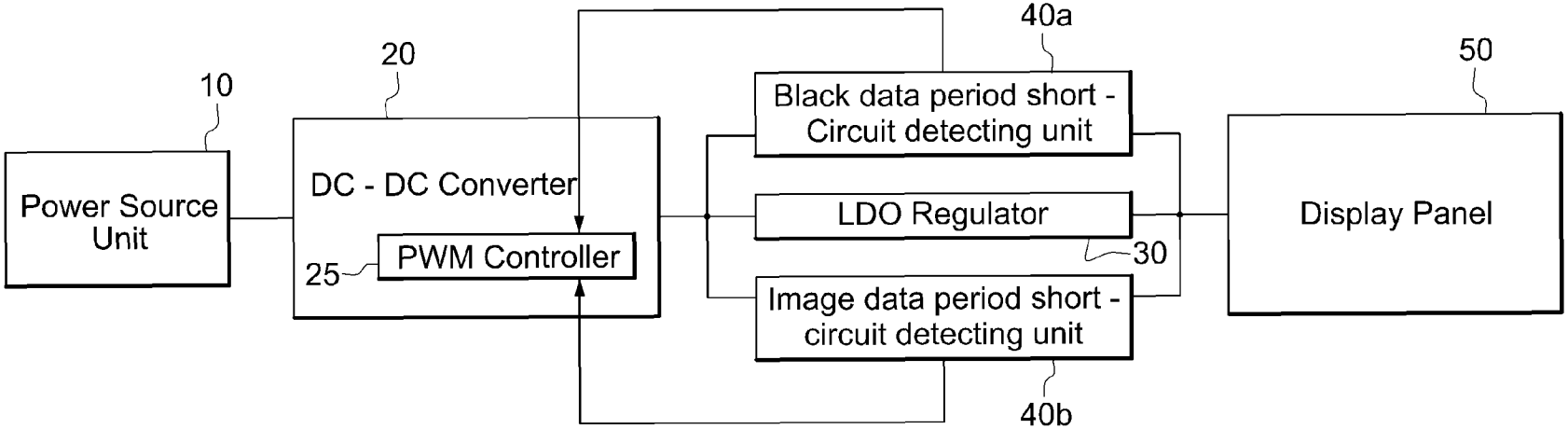
FIG. 5 is a diagram schematically illustrating an apparatus for driving a display panel according to a third embodiment.

FIG. 5 is a diagram schematically illustrating an apparatus for driving a display panel according to a third embodiment.

In FIG. 5, a power source unit 10 supplies a constant voltage to a DC-DC converter 20.

The DC-DC converter 20 raises the constant voltage supplied to the power source unit 10 to a drive voltage of a display panel 50 so as to be output.

The DC-DC converter 20 includes a PWM controller 25 for controlling driving of the DC-DC converter 20.

The PWM controller 25 controls an output voltage of the DC-DC converter 20 on the basis of signals applied from a black data period short-circuit detecting unit 40*a* and a image data period short-circuit detecting unit 40*b*.

That is, the PWM controller 25 applies a voltage from the DC-DC converter 20 to the display panel 50 in a case where a low-level signal is applied from the black date period short-circuit detecting unit 40*a* or the image date period short-circuit detecting unit 40*b*. And, the PWM controller 25 turns off the voltage applied from the DC-DC converter 20 to the display panel 50 in a case where a high-level signal is applied from the black date period short-circuit detecting unit 40*a* or the image date period short-circuit detecting unit 40*b*.

Here, the each operation principle of the black date period short-circuit detecting unit 40*a* and the image date period short-circuit detecting unit 40*b* is already explained in the FIG. 1-FIG. 4.

An LDO regulator 30 drops the output voltage of the DC-DC converter 20 and supplies the dropped voltage to the display panel 50.

Figure 6:
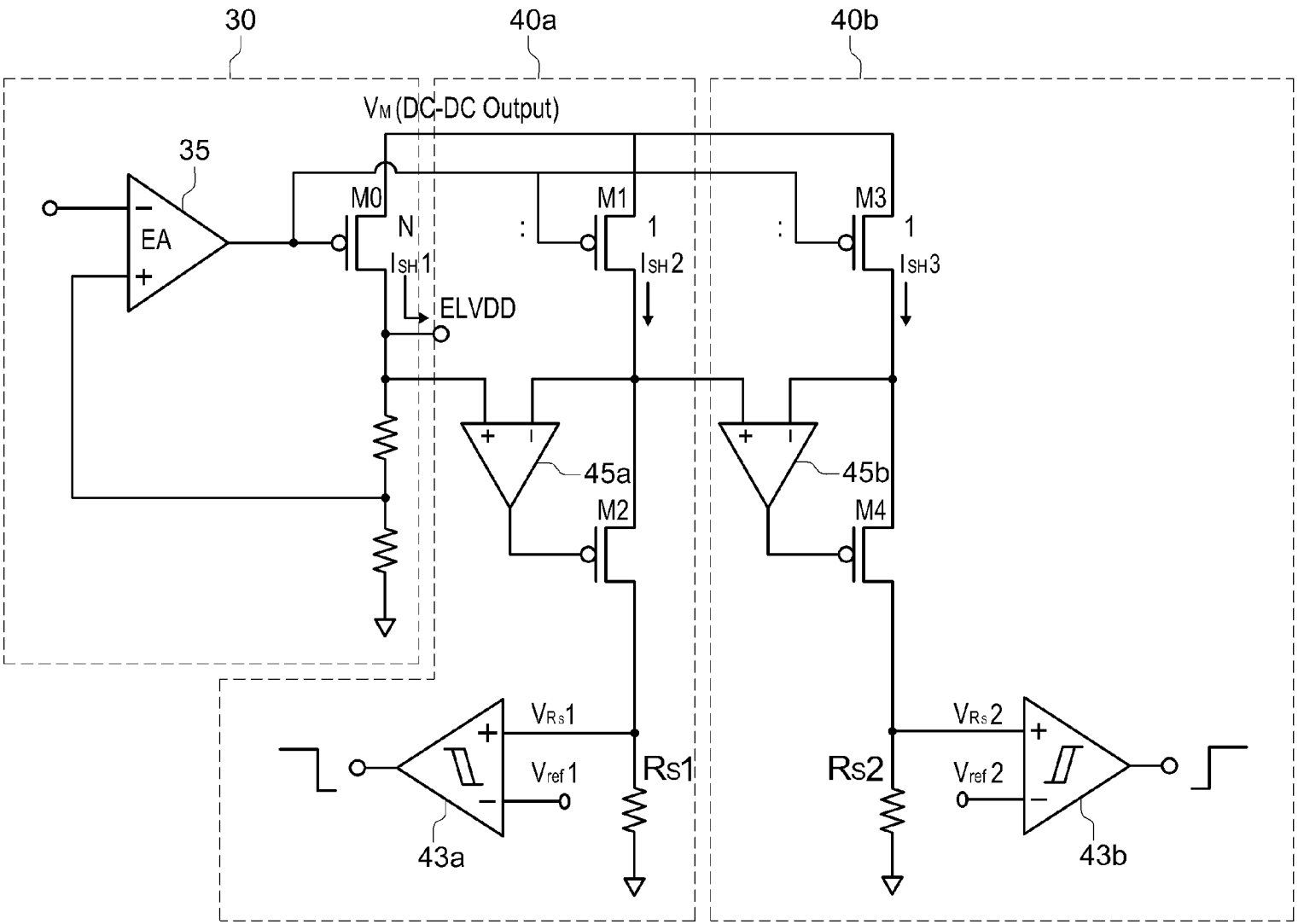
FIG. 6 is a circuit diagram illustrating a black data period short-circuit detecting unit and a image data period short-circuit detecting unit according to the third embodiment.

FIG. 6 is a circuit diagram illustrating the black date period short-circuit detecting unit 40*a* and the image date period short-circuit detecting unit 40*b* according to the third embodiment.

As illustrated in FIG. 6, the black date period short-circuit detecting unit 40*a* includes a first sensing transistor M1, a first resistor $R_S$1, a first comparator 43*a*, a first operational amplifier 45*a*, and a first transistor M2. The image data period short-circuit detecting unit 40*b* includes a second sensing transistor M3, a second resistor $R_S$2, a second comparator 43*b*, a second operational amplifier 45*b*, and a second transistor M4.

Here, the first sensing transistor M1, the first resistor $R_S$1, the first comparator 43*a*, the first operational amplifier 45*a*, and the first transistor M2 correspond to a sensing transistor M1, a resistor $R_S$, a comparator 43, a operational amplifier 45, and a transistor M2 in FIG. 2 individually.

The pass transistor M0 of the LDO regulator 30 and the second sensing transistor M3 of the image data period short-circuit detecting unit 40*b* are implemented at a ratio of N:1 (for example, 100:1) to detect a short-circuit current flowing through the pass transistor M0 while the display panel 50 is driven and the drive current is applied to the display panel 50. Here, the magnitude of the current that can be detected by the second sensing transistor M3 varies depending on the ratio of the pass transistor M0 and the second sensing transistor M3. Thus, the level of the short-circuit current that can be detected by the image data period short-circuit detecting unit 40*b* may be adjusted by changing the ratio of the pass transistor M0 and the second sensing transistor M3.

The second sensing transistor M3 may be implemented as a PMOS transistor. In this case, a signal output from the error amplifier 35 of the LDO regulator 30 is applied to a gate terminal of the PMOS transistor M3, and the output voltage $V_M$ of the DC-DC converter 20 is applied to a source terminal thereof.

The second resistor $R_S$2 is connected to a drain terminal of the second sensing transistor M3 to convert a drive current $I_{SH}$3 detected by the second sensing transistor M3 into a second voltage $V_{Rs}$2. Here, the value of the second voltage $V_{Rs}$2 varies depending on the resistance of the second resistor $R_S$2. Thus, the level of the short-circuit current that can be detected by the image data period short-circuit detecting unit 40*b* may be adjusted by changing the resistance of the second resistor $R_S$2.

As described above, the level of the drive current that can be detected by the image data period short-circuit detection unit 40*b* may be adjusted by changing the ratio of the pass transistor M0 and the second sensing transistor M3, and the resistance of the second resistor $R_S$2. Accordingly, whether or not the drive current exceeds the maximum drive current can be detected using the short-circuit current that occurs due to the micro-short circuit.

The second comparator 43*b* compares the second voltage $V_{Rs}$2 converted by the second resistor $R_S$2 with a second reference voltage $V_{ref}$2 and outputs a short-circuit detection signal.

The second comparator 43*b* outputs a short-circuit detection signal of a low level to the PWM controller 25 of the DC-DC converter 20 until the second voltage $V_{Rs}$2 converted by the second resistor $R_S$2 becomes greater than the second reference voltage $V_{ref}$2, and outputs a short-circuit detection signal of a high level to the PWM controller 25 of the DC-DC converter 20 when the second voltage $V_{Rs}$2 converted by the second resistor $R_S$2 becomes equal to or greater than the second reference voltage $V_{ref}$2.

Accordingly, the PWM controller 25 that receives the short-circuit detection signal of the low level from the second comparator 43*b* generates a PWM control signal and applies it to a switch transistor (not shown) so as to apply power from the DC-DC converter 20 to the display panel 50. In a case where the PWM controller 25 receives the short-circuit detection signal of the high level from the second comparator 43*b*, the PWM controller 25 does not generate the PWM control signal to be output to the switch transistor (not shown) so as not to apply power from the DC-DC converter 20 to the display panel 50.

The image data period short-circuit detecting unit 40*b* may further include the second operational amplifier 45*b* and the second transistor M4 so as to cause voltages output from drain terminals of the pass transistor M0 and the second sensing transistor M3 to be equal to each other.

The voltage output from the drain terminal of the pass transistor M0 is input to a non-inverting input terminal (+) of the above-mentioned second operational amplifier 45*b*, and the voltage output from the drain terminal of the second sensing transistor M3 is input to an inverting input terminal (−) thereof.

The second transistor M4 is implemented between the second sensing transistor M3 and the second resistor $R_S$2, and depending on an output voltage of the second operational amplifier 45*b* input through a gate terminal thereof, receives the drive current $I_{SH}$3 output from the second sensing transistor M3 through a source terminal thereof to output it to the second resistor $R_S$2.

Figure 7:
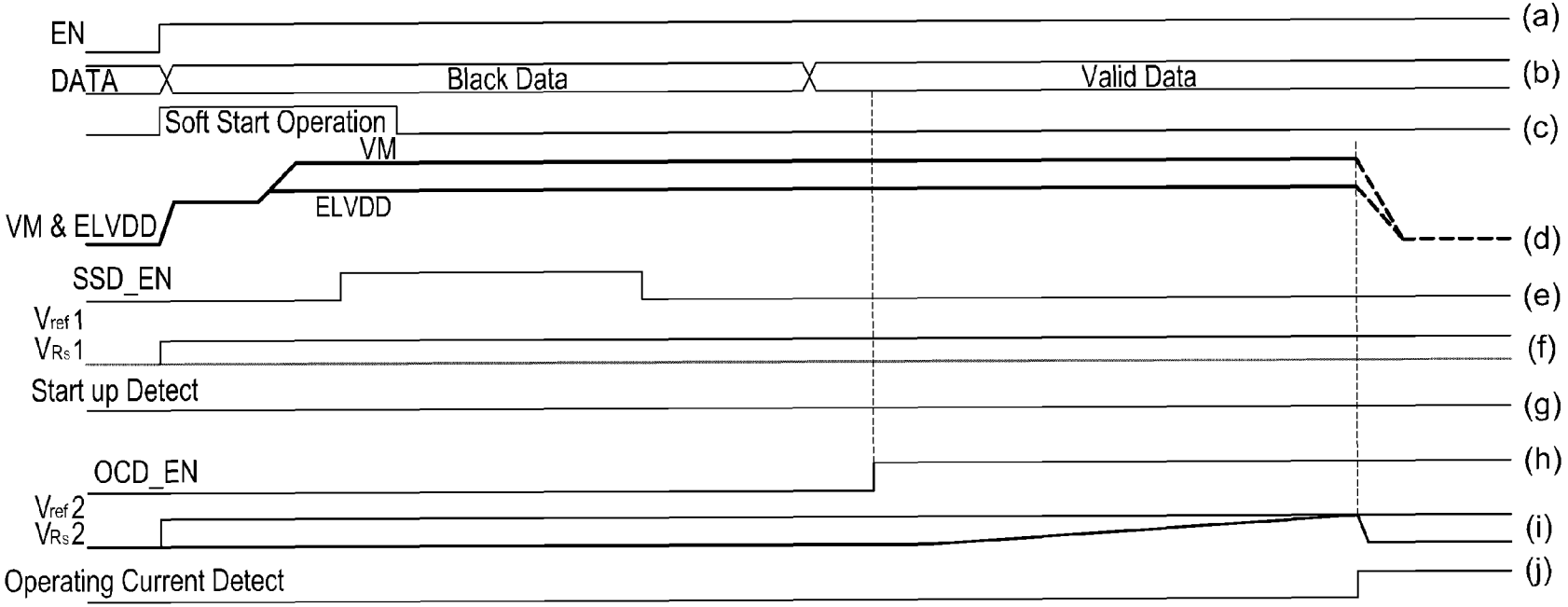
FIG. 7 is timing diagrams of operations of an apparatus for driving a display panel according to the third embodiment.

FIG. 7 is timing diagrams of operations of an apparatus for driving a display panel according to a third embodiment. In FIG. 7, the display panel 50 is in a normal state during the black data period in which the black data is applied. In a case where a crack occur in the display panel 50 during the black data period, the timing diagram of operations of the apparatus for driving a display panel is already explained in FIG. 3.

As illustrated in FIG. 7, when the display panel 50 is enabled in response to the display panel drive signal (a), black data is applied for a preset time (for example, 16 ms) to the display panel 50, and thereafter image data is applied (b).

In order to detect a crack that occurs in the display panel 50 during the black data period, after a soft-start operation (c), the black data period short-circuit detecting unit 40*a* is enabled from a time point at which the power source ELVDD is stabilized (e).

As described above, when the black data period short-circuit detecting unit 40*a* is enabled during the black data period, the first sensing transistor M1 of the black data period short-circuit detecting unit 40*a* detects a short-circuit current flowing to the pass transistor M0 of the LDO regulator 30. In the case where the display panel 50 is in the normal state, the short-circuit current is not detected (f), and the short-circuit detection signal of the low level is output to the PWM controller 25 of the DC-DC converter 20 (g).

After the black data is applied to the display panel 50 for the preset period, image data is applied (b). During the image data period in which the image data is applied, in the case where the display panel 50 is in the normal state, a current equal to or smaller than the maximum drive current flows to the display panel 50. However, in a case where a crack occurs in the display panel 50 during the operation of the display panel 50 and the power sources ELVDD and ELVSS are short-circuited, a current that exceeds the maximum drive current flows to the display panel 50.

Accordingly, in order to detect whether or not the drive current applied to the display panel 50 exceeds the maximum drive current, after the image data is applied to the display panel 50, the image data period short-circuit detecting unit 40*b* is enabled (h).

As described above, when the power sources ELVDD and ELBVSS are short-circuited due to the crack in the display panel 50 and the drive current flowing from the DC-DC converter 20 to the display panel 50 exceeds the maximum drive current due to the short-circuit current, this is detected by the image data period short-circuit detecting unit 40*b* which is enabled during the image data period detects.

That is, when the image data period short-circuit detecting unit 40*b* is enabled, the second sensing transistor M3 of the image data period short-circuit detecting unit 40*b* detects a drive current flowing through the pass transistor M0 of the LDO regulator 30.

In the case where there is no crack in the display panel 50, a drive current in a normal range flows to the display panel 50 from the DC-DC converter 20. That is, the drive current does not exceed the maximum.

As such, when the drive current in the normal range which does not exceed the maximum drive current flows to the display panel 50 from the DC-DC converter 20, the second voltage $V_{Rs}$2 applied to the non-inverting input terminal (+) of the second comparator 43*b* is smaller than the second reference voltage $V_{ref}$2 applied to the inverting input terminal (−) of the second comparator 43*b*, and the short-circuit detection signal of the low level is output to the PWM controller 25 of the DC-DC converter 20.

The PWM controller 25 that receives the short-circuit detection signal of the low level from the image data period short-circuit detecting unit 40*b* generates the PWM control signal and applies it to the switch transistor (not shown) so as to apply power from the DC-DC converter 20 to the display panel 50.

On the other hand, in the case where a crack occurs in the display panel 50, the drive current that exceeds the maximum drive current flows from the DC-DC converter 20 to the display panel 50.

As such, when the drive current that exceeds the maximum drive current flows from the DC-DC converter 20 to the display panel 50, a drive current $I_{SH}$1 that exceeds the maximum drive current flows through the pass transistor M0 of the LDO regulator 30. In this case, the drive current $I_{SH}$3 that exceeds the maximum drive current also flows through the second sensing transistor M3 of which the gate terminal is connected to the output signal of the error amplifier 35 like the pass transistor M0 and of which the source terminal is connected to the output voltage $V_M$ of the DC-DC converter 20.

Here, magnitudes of the drive current $I_{SH}$1 flowing through the pass transistor M0 and the drive current $I_{SH}$3 flowing through the second sensing transistor M3 vary depending on the ratio of the pass transistor M0 and the second sensing transistor M3. For example, in the case where the ratio of the pass transistor M0 and the first sensing transistor M1 is 100:1, if a drive current $I_{SH}$1 of 100 mA flows through the pass transistor M0, a drive current $I_{SH}$3 of 1 mA flows through the second sensing transistor M3.

As described above, the drive current $I_{SH}$3 flowing through the second sensing transistor M3 is converted into the second voltage $V_{Rs}$2 by the second resistor $R_S$2 and applied to the non-inverting input terminal (+) of the second comparator 43*b*. In this case, when the second voltage $V_{Rs}$2 converted by the second resistor $R_S$2 becomes equal to or greater than the second reference voltage $V_{ref}$2 connected to the inverting input terminal (−) of the second comparator 43*b*, as illustrated by (i) of FIG. 7, the short-circuit detection signal of the high level is output to the PWM controller 25 of the DC-DC converter 20, as illustrated by (j) of FIG. 7.

The PWM controller 25 which receives the short-circuit detection signal of the high level from the image data period short-circuit detecting unit 40*b* does not generate the PWM control signal to be applied to the switch transistor (not shown) so as not to apply power from the DC-DC converter 20 to the display panel 50.

As described above, the apparatus for driving a display panel according to this disclosure detects whether or not short-circuit current due to cracks that occur in the display panel 50 flows by enabling the black data period short-circuit detecting unit 40*a* during the black data period, and controls the power applied to the display panel 50 from the DC-DC converter 20 according to the detection result, thereby preventing the display panel, the DC-DC convert, the inductor, and the like from being excessively heated.

In addition, during the image data period, the apparatus detects whether or not the drive current applied to the display panel 50 from the DC-DC converter 20 exceeds the maximum drive current due to the cracks that occur during the driving of the display panel 50 by enabling the image data period short-circuit detecting unit 40*b*. In addition, according to the detection result, the apparatus controls the power to be applied to the display panel 50 from the DC-DC converter 20, thereby preventing the display panel, the DC-DC converter, the inductor, and the like from being excessively heated.

Depending on situations, although a current of, for example, up to 200 mA is applied to the display panel 50 from the DC-DC converter 20, the current applied to the display panel 50 should not exceed 120 mA for normal operations of the inductor or external components in consideration of the size value of the inductor or characteristics of the external components. In such cases, the image data period short-circuit detecting unit 40*b* is enabled during the image data period to detect whether or not the drive current applied to the display panel 50 from the DC-DC converter 20 exceeds the maximum drive current due to surrounding environments. The power applied to the display panel 50 from the DC-DC converter 20 is controlled by the detection result and, thus, overcurrent does not flow through the inductor or the external components. Accordingly, the inductor, the external components, the DC-DC converter 20, and the like can be protected.

While the exemplary embodiments have been shown and described, it will be understood by those skilled in the art that various changes in form and details may be made thereto without departing from the spirit and scope of this disclosure as defined by the appended claims.

In addition, many modifications can be made to adapt a particular situation or material to the teachings of this disclosure without departing from the essential scope thereof. Therefore, it is intended that this disclosure not be limited to the particular exemplary embodiments disclosed as the best mode contemplated for carrying out this disclosure, but that this disclosure will include all embodiments falling within the scope of the appended claims.

What is claimed is:

1. An apparatus for driving a display panel comprising:

a display panel;

a DC-DC converter for raising a constant voltage supplied from a power source unit to a drive voltage of the display panel and outputting the raised voltage;

a low-dropout (LDO) regulator for dropping an output voltage of the DC-DC converter and supplying the dropped output voltage to the display panel;

a black data period short-circuit detecting unit which is enabled during a black data period in which current should not flow through the display panel, detects a short circuit by detecting a short-circuit current applied to the display panel through the LDO regulator, and outputs a short-circuit detection signal to the DC-DC converter according to the short-circuit detection result, thereby controlling the output voltage of the DC-DC converter; and a image data period short-circuit detecting unit which is enabled during an image data period in which image data is applied to the display panel, detects a short circuit by detecting whether or not a drive current applied to the display panel through the LDO regulator exceeds a maximum drive current, and outputs a short-circuit detection signal to the DC-DC converter according to the short-circuit detection result, thereby controlling the output voltage of the DC-DC converter.

2. The apparatus according to claim 1, wherein the black data period short-circuit detecting unit includes:

a first sensing transistor which is configured so that a pass transistor of the LDO regulator and the sensing transistor are implemented at a ratio of N:1, and detects a drive current flowing through the pass transistor;

a first resistor which is connected to a drain terminal of the first sensing transistor and converts the short-circuit current detected by the first sensing transistor into a voltage; and a first comparator which compares the voltage converted by the first resistor with a first reference voltage and outputs a short-circuit detection signal.

3. The apparatus according to claim 1, wherein the image data period short-circuit detecting unit includes:

a second sensing transistor which is configured so that a pass transistor of the LDO regulator and the sensing transistor are implemented at a ratio of N:1, and detects a drive current flowing through the pass transistor;

a second resistor which is connected to a drain terminal of the second sensing transistor and converts the drive current detected by the second sensing transistor into a voltage; and a second comparator which compares the voltage converted by the second resistor with a second reference voltage and outputs a short-circuit detection signal.

* * * * *